US005851121A

United States Patent [19]

Thenaisie et al.

[11] Patent Number: 5,851,121

[45] Date of Patent: Dec. 22, 1998

[54] MINIATURE SHIELDED CONNECTOR WITH ELBOW CONTACT SHAFTS

[75] Inventors: Jacky Thenaisie, Le Mans; Jacques-Henri Heulot, Cergy, both of France

[73] Assignee: Framatome Connectors International, Courbevoie, France

[21] Appl. No.: 829,109

[22] Filed: Mar. 31, 1997

[30] Foreign Application Priority Data

Apr. 1, 1996 [FR] France ..... 96/04057

[51] Int. Cl.[6] ..... H01R 9/09

[52] U.S. Cl. ..... 439/63; 439/608

[58] Field of Search ..... 439/63, 608, 581, 439/579

[56] References Cited

U.S. PATENT DOCUMENTS

| | | | |
|---|---|---|---|
| 4,914,062 | 4/1990 | Voltz | 439/608 |
| 5,169,343 | 12/1992 | Andrews | 439/608 |
| 5,516,307 | 5/1996 | Cartesse et al. | 439/63 |
| 5,577,935 | 11/1996 | Harting et al. | 439/581 |

FOREIGN PATENT DOCUMENTS

| | | |
|---|---|---|
| 0446980 A1 | 9/1991 | European Pat. Off. . |
| 0488482 A1 | 6/1992 | European Pat. Off. . |
| 0547979 A1 | 6/1993 | European Pat. Off. . |
| 0613215 A1 | 8/1994 | European Pat. Off. . |
| 2262473 | 9/1975 | France . |
| 2552939 | 5/1985 | France . |
| 2702095 | 9/1994 | France . |
| 4438872 C1 | 12/1995 | Germany . |

*Primary Examiner*—Steven L. Stephan
*Assistant Examiner*—T C Patel
*Attorney, Agent, or Firm*—Perman & Green, LLP

[57] ABSTRACT

The connector comprises a series of metal contact shafts (1) spaced and bent into elbow configurations, embedded in an electrically insulating material (2) which is itself surrounded by a metal shielding (3). Electrically insulating material (2) is molded around contact shafts (1), shielding (3) is made up of two superposed metal blocks (4*a*) having on their contacting surfaces elbow channels (5*a*, 5*b*, 5*c*) taking up contact shafts (1) surrounded by electrically insulating material (2), these channels being formed so that shielding (3) is interrupted in one rectilinear part of the elbow formed by the channels, this interruption of shielding placing in contact insulating material (2) surrounding the contact shafts, without creating any empty space in zones (7*a*, 7*b*) where the shielding is interrupted.

10 Claims, 6 Drawing Sheets

MINIATURE SHIELDED CONNECTOR WITH ELBOW CONTACT SHAFTS

BACKGROUND OF THE INVENTION

1. Field of the Invention

The present invention concerns a miniature shielded connector, with elbow contact shafts electrically insulated opposite the shielding.

The invention also pertains to the manufacturing process for the above connector.

This type of connector has barbs projecting from one of its surfaces, designed to be attached, for example, by soldering to a printed circuit. On one surface situated at a right angle relative to the above surface, shielding sockets project and coaxially surround female contact tips connected to the elbow contact shafts.

Such connectors should be as small as possible, their elbow contact shafts thus being very close to one another, while being perfectly insulated electrically and efficaciously shielded.

2. Prior Art

The documents below illustrate the prior art relating to connectors of the above-mentioned type:

EP-A-0 448,482

U.S. Pat. No. 5,169,343

EP-A-0 446,980

U.S. Pat. No. 4,914,062

FR-A-2,552,939

FR-A-2,262,473

EP-A-0 547,979

EP-A-0 613,215

FR-A-2,702,095

DE-B-4,438,872

Except for DE-B-4,438,872, all of the above documents describe connectors in which a perfect shielding continuity is produced between the contact shafts.

In the case of DE-B-4,438,872, the shielding is not continuous between the contact shafts. However, there are empty spaces between the shafts that increase the size of the connector.

Moreover, the connectors illustrated by the prior art given above are all-in-all relatively costly to manufacture.

The objective of the present invention is to remedy the disadvantages of known connectors, by creating a connector of reduced size, of inexpensive manufacture, and in which the contact shafts are perfectly insulated and shielded from one another.

The invention thus pertains to a connector comprising a series of spaced and 90°-bent metal contact shafts, embedded in an electrically insulating material which is itself surrounded by a metal shielding.

SUMMARY OF THE INVENTION

According to the invention, this connector is characterized in that the electrically insulating material is molded around the contact shafts, in that the shielding is made up of two superposed metal blocks having elbow channels on their contacting surfaces and these channels take up the contact shafts surrounded by the electrically insulating material, these channels being formed in such a way that the shielding is interrupted in one rectilinear part of the elbow formed by the channels, this shielding interruption placing in contact the insulating material surrounding the contact shafts without creating any empty space in the zones where the shielding is interrupted.

Tests have shown that the shielding interruption between the elbow contact shafts has no deleterious effect with regard to the overall quality of shielding.

This interruption of shielding and the absence of empty spaces between the contact shafts permit reducing the size of the connector.

Moreover, due to the fact that the shielding is made up of a number of pieces reduced to two blocks and that the insulating material is molded onto the contact shafts, the manufacture of the connector is both simple and inexpensive.

According to the invention, the manufacturing process of the connector conforming to the invention comprises the following steps:

contact shafts are made by cutting these shafts in a sheet metal, this cutting leaving in place connection cross-pieces between the shafts close to the ends of the latter, an insulating material is molded around the contact shafts, the connection cross-piece situated close to one of the ends of the contact shafts is cut, the assembly thus obtained is positioned in the channels of one of the shielding blocks, the other shielding block is placed above the shielding block having the above assembly, so that its channels cover the insulating material of the contact shafts, the shielding sockets are placed in the conduits of one of the blocks and, the other joining cross-piece is cut.

Other particular points and advantages of the invention will appear in the description below.

BRIEF DESCRIPTION OF THE DRAWINGS

In the attached drawings, given by way of non-limiting example.

DETAILED DESCRIPTION

In the embodiment of FIGS. 1 to 5, the connector according to the invention comprises a series of metal contact shafts 1, spaced and bent into an elbow, embedded in an electrically insulating material 2 which is itself surrounded by a metal shielding 3.

According to the invention, electrically insulating material 2 is molded around contact shafts 1, shielding 3 is made up of two superposed metal blocks 4*a*, 4*b*, having elbow channels 5*a*, 5*b*, 5*c*; 6*a*, 6*b*, 6*c* on their surfaces in contact, and these channels take up contact shafts 1 surrounded by the electrically insulating material. These channels 5*a*, 5*b*, 5*c*; 6*a*, 6*b*, 6*c* are formed in such a way that the shielding provided by the metal block 4*a*, 4*b* directly between the metal contact shafts 1 is interrupted in a rectilinear part 7*a*, 7*b* (see the dotted lines in FIG. 1) of the elbow formed by channels 5*a*, 5*b*, 5*c*; 6*a*, 6*b*, 6*c*. The open areas in the blocks 4*a*, 4*b* at areas 7*a*, 7*b* provide a recessed receiving seat for portions of the insulating material 2 located between and connecting the contact shafts 1 to each other. This can be seen in FIG. 10 where the connecting portions of the insulating material 2 are shown in recesses between cavities 5*c* and 5*b*, and 5*b* and 5*a* of the block 4*a*.

This shielding interruption 7*a*, 7*b* places in contact insulating material 2 surrounding contact shafts 1 without creating any empty space in the zone where the shielding is interrupted.

Preferably, the two metal blocks 4*a*, 4*b* of shielding 3 are molded.

As shown by FIGS. 2 to 5, the contacting surfaces 8*a*, 8*b* of the two shielding blocks 4*a*, 4*b* are flat.

Figure 4:
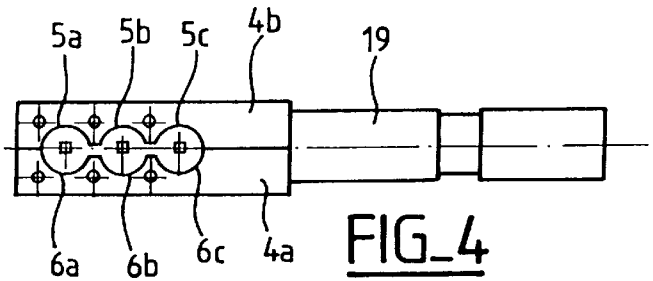
FIG. 4 is a plane view according to arrow $F_1$ of FIG. 1.
Figure 3:
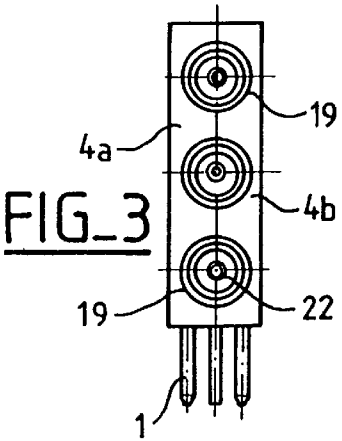
FIG. 3 is a plane view according to arrow F of FIG. 1.
Figure 6:
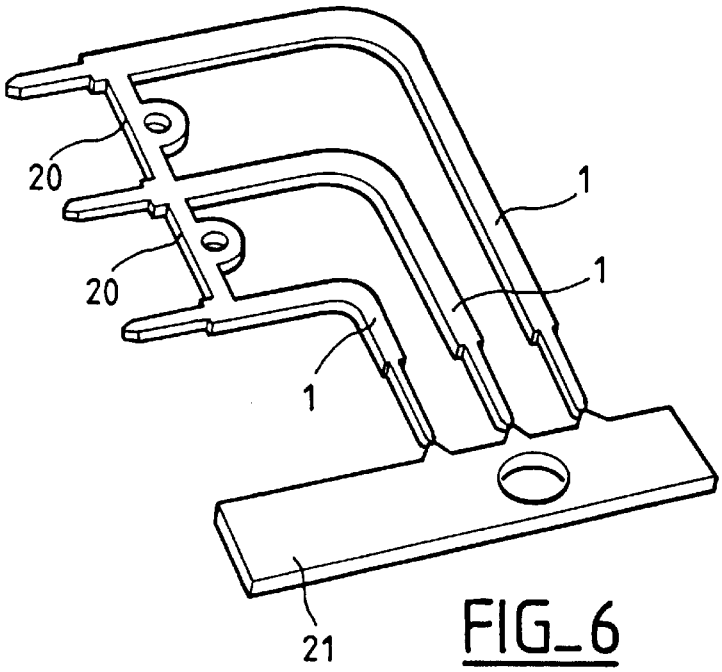
FIG. 6 is a perspective view illustrating the step of cutting the contact shafts in the process according to the invention.

As shown by FIG. 4, each channel 5*a*, 5*b*, 5*c*; 6*a*, 6*b*, 6*c*, formed in one of blocks 4*a*, 4*b* forms with the adjacent channel of the other block a conduit of circular section that surrounds the insulating material and contact shafts 1.

Figure 5:
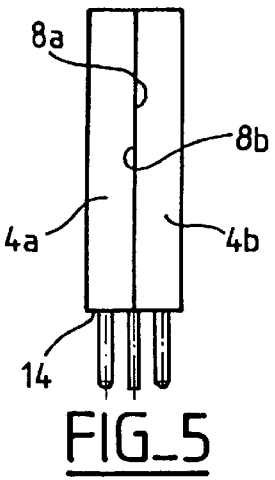
FIG. 5 is a plane view according to arrow $F_2$ of FIG. 1.
Figure 2:
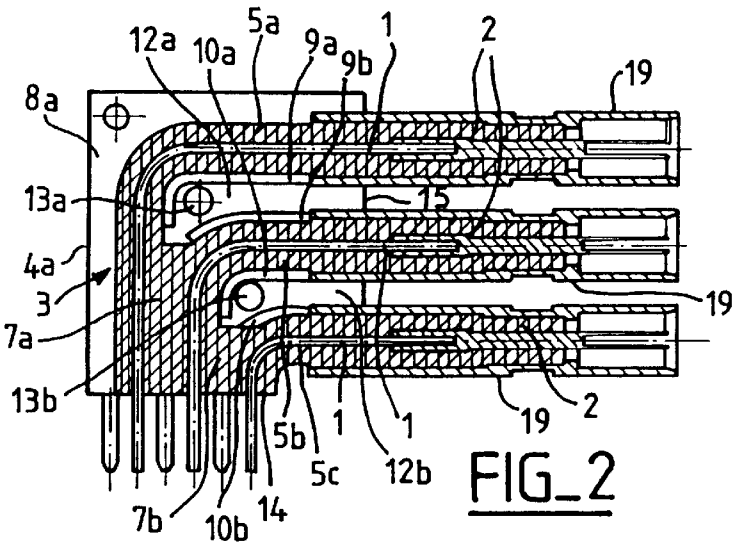
FIG. 2 is a cross-sectional elevation view showing the side of the far shielding block and showing in section the insulating material surrounding the contact shafts.
Figure 1:
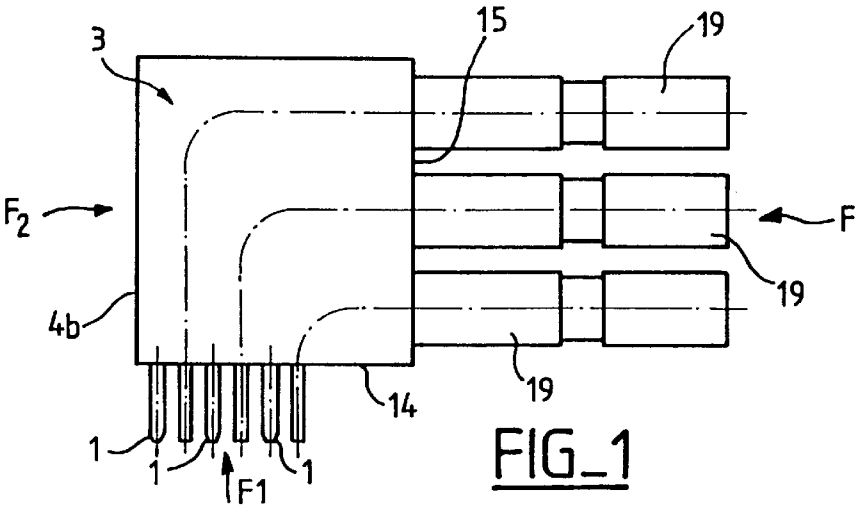
FIG. 1 is a side elevation view of a shielded connector according to the invention.

It is seen in FIGS. 1 and 2 that shielding 3 completely surrounds insulating material 2 in one part of the elbow, (the horizontal part in FIG. 2) formed by channels 5*a*, 5*b*, 5*c*; 6*a*, 6*b*, 6*c*. Parts 9*a*, 9*b*; 10*a*, 10*b* of the shielding, which are comprised between two adjacent contact shafts surrounded by insulating material 2, are separated by a recess 12*a*, 12*b*.

As shown in FIG. 2, recess 12*a*, 12*b* extends over the entire length of parts 9*a*, 9*b*; 10*a*, 10*b* of the shielding and is open at each of its ends.

Moreover, recesses 12*a*, 12*b* each have a hole 13*a*, 13*b* for the passage of an assembly screw for the two shielding blocks 4*a*, 4*b*.

In the example shown in FIGS. 1 to 5, the two shielding blocks 4*a*, 4*b* are roughly parallelepipedic and channels 5*a*, 5*b*, 5*c*; 6*a*, 6*b*, 6*c* formed in the latter emerge on two adjacent lateral surfaces 14, 15 situated at a right angle to one another.

Figure 10:
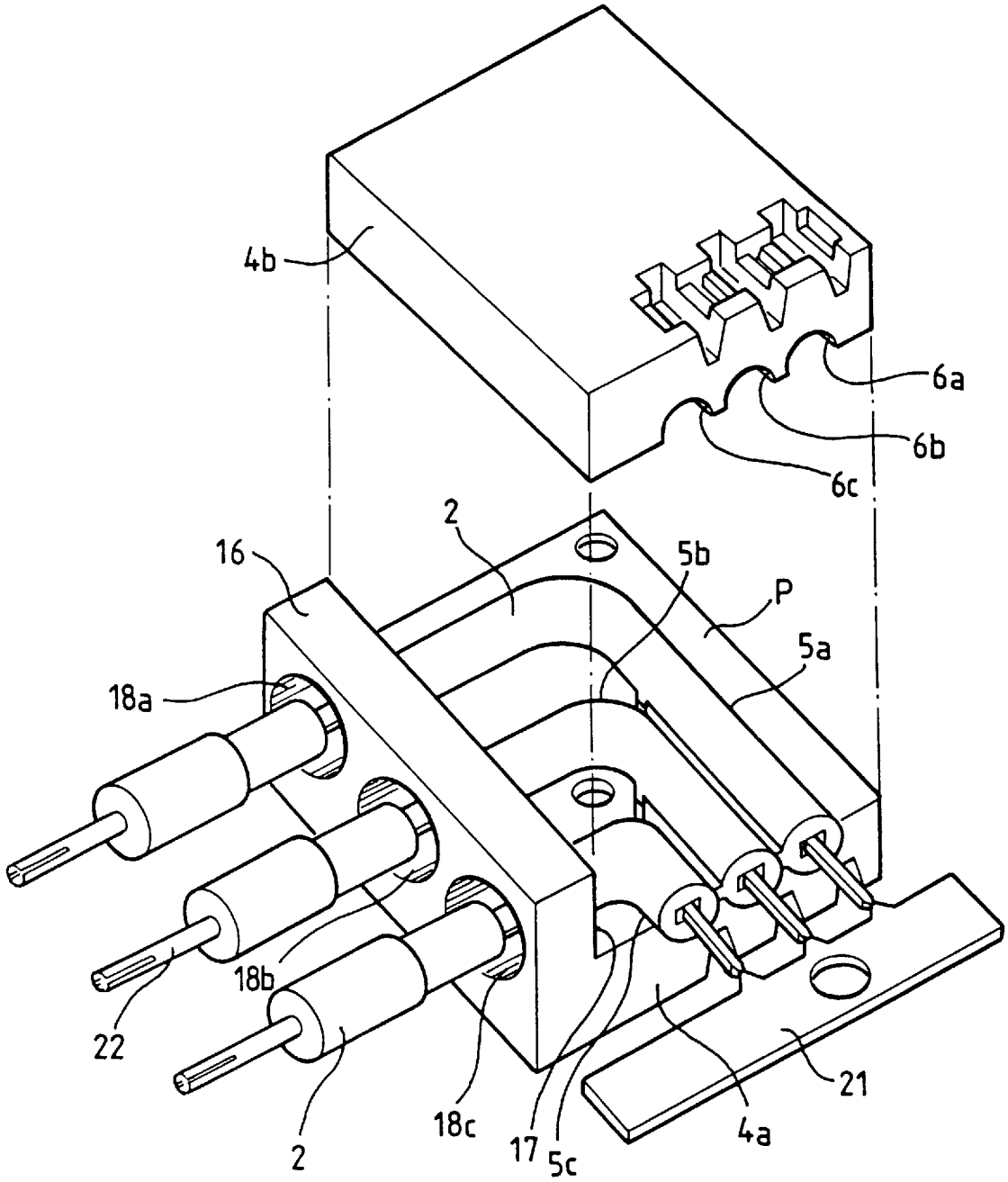
FIG. 10 illustrates the step of positioning the contact shafts surrounded with insulating material between the two shielding blocks.

One sees in FIG. 10 that one (4*a*) of the shielding blocks has, along one of its lateral surfaces, a protuberance 16 defining a bearing surface 17 perpendicular to plane P for assembly of the two blocks 4*a*, 4*b*. The other block 4*b* is supported on this bearing surface 17, and channels 5*a*, 5*b*, 5*c*; 6*a*, 6*b*, 6*c* formed in blocks 4*a*, 4*b* commence outside protuberance 16 contiguous with circular conduits 18*a*, 18*b*, 18*c*.

Figure 11:
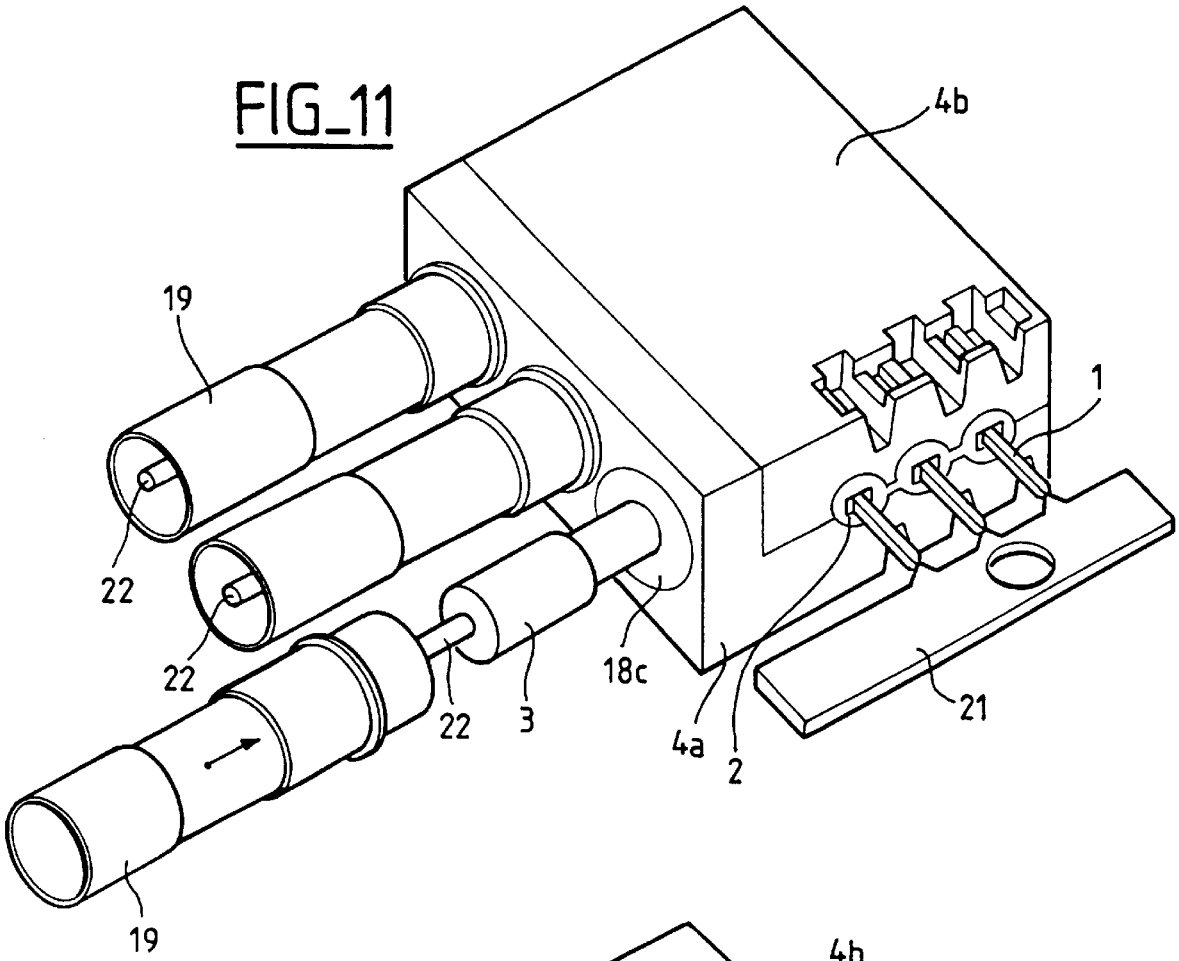
FIG. 11 illustrates the step of positioning the shielding sockets.
Figure 12:
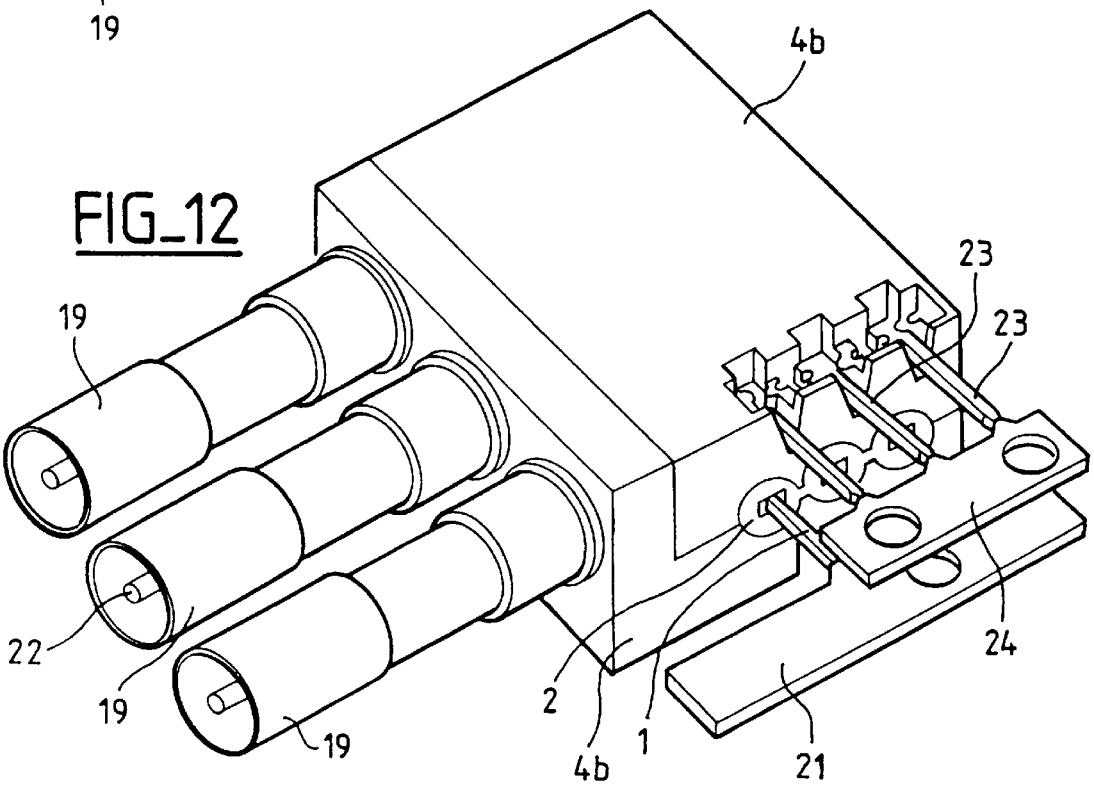
FIG. 12 illustrates the step of positioning the barbs.

On the other hand, it is seen in FIGS. 2 and 10 that insulating material 2 molded around contact shafts 1 projects outside circular conduits 18*a*, 18*b*, 18*c* and is surrounded by a shielding socket 19 for each contact shaft 1 (see also FIGS. 11 and 12). These sockets 19 are pressed into circular conduits 18*a*, 18*b*, 18*c*, so as to be in contact with shielding 3 of blocks 4*a*, 4*b*.

We will now describe the process for manufacture of a connector according to the invention, in reference to FIGS. 6 to 13.

In a first step (see FIG. 6), elbow contact shafts 1 are created by cutting the shafts in a sheet metal. This cutting leaves connection cross-pieces 20, 21 in place between shafts 1 close to the ends of the latter.

Figure 7:
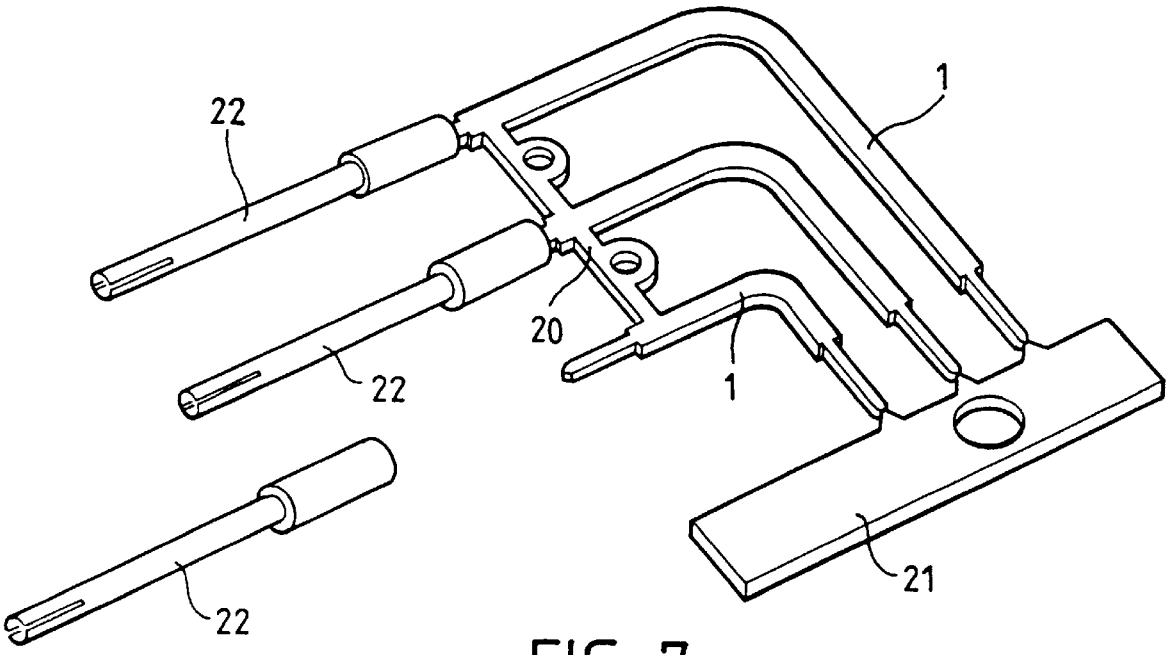
FIG. 7 illustrates the step of positioning the female contact tips.
Figure 8:
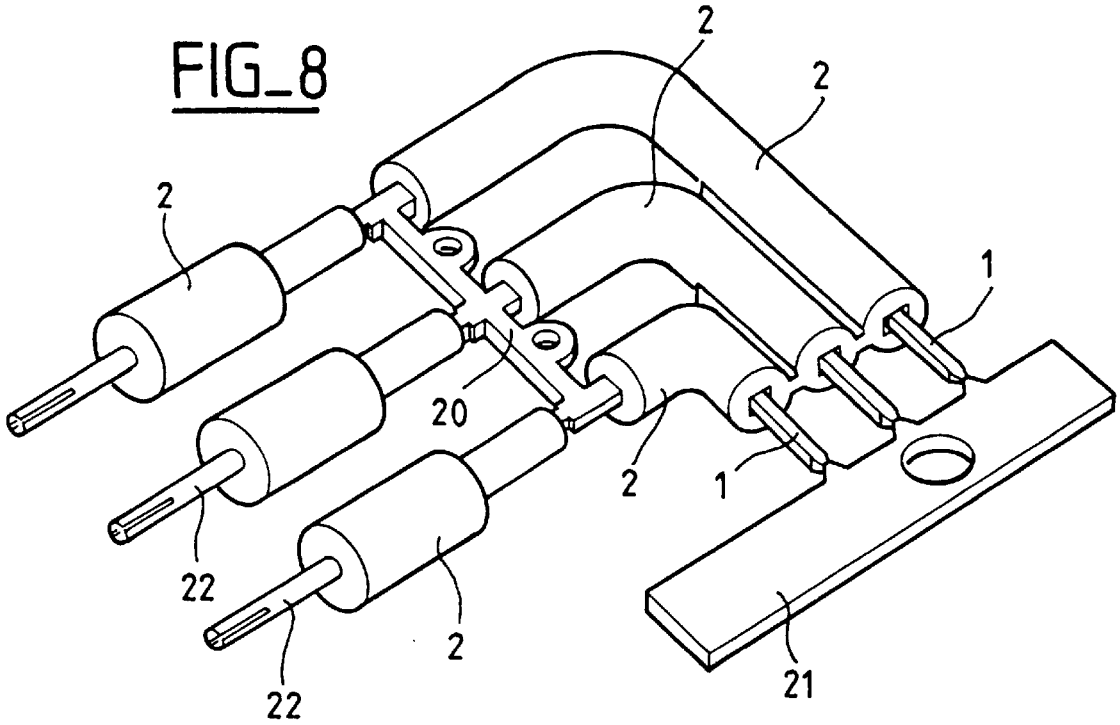
FIG. 8 illustrates the step of molding the insulating material.

In the second step illustrated by FIG. 7, female contact tips 22 are attached onto the free ends of the contact shafts.

In a final step (see FIG. 8), an insulating material 2 is molded around contact shafts 1.

Figure 9:
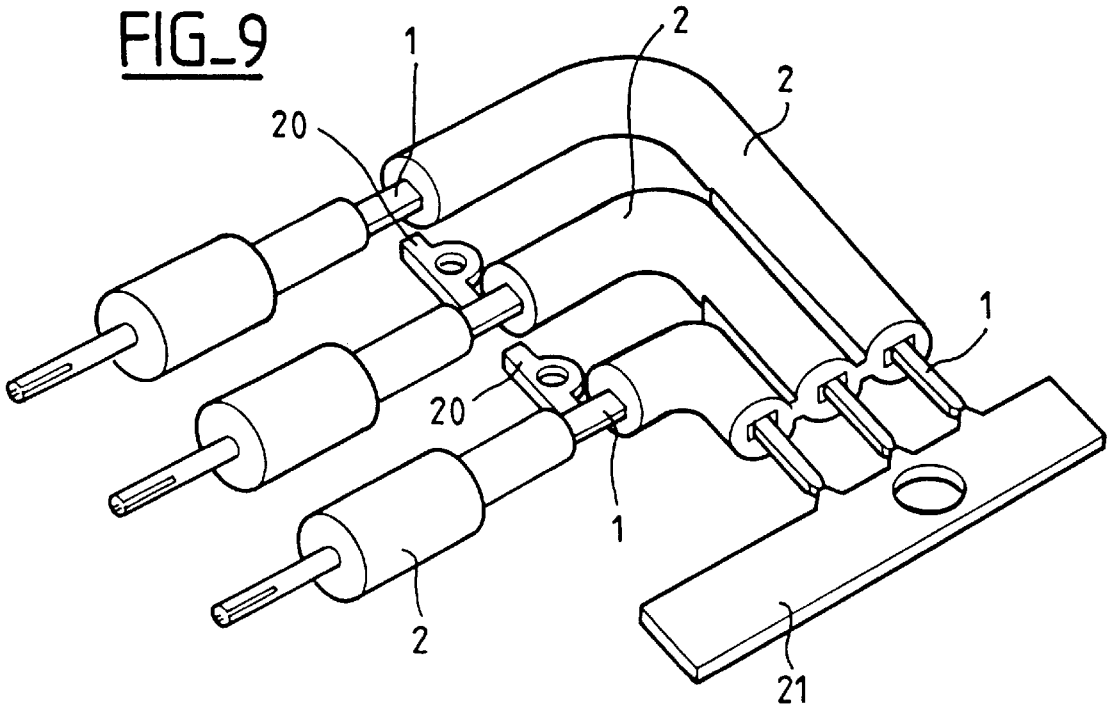
FIG. 9 illustrates the step of cutting a connection cross-piece.

In the following step, illustrated by FIG. 9, connection cross-piece 20 situated close to one of the ends of contact shaft 1 is cut.

In the step shown by FIG. 10, the assembly obtained from the preceding step is positioned in channels 5*a*, 5*b*, 5*c* of shielding block 4*a*, then the other shielding block 4*b* is positioned above shielding block 4*a*, having the above assembly, so that its channels 6*a*, 6*b*, 6*c* cover insulating material 2 of contact shafts 1.

In the following step (see FIG. 11), shielding sockets 19 are positioned in conduits 18*a*, 18*b*, 18*c* of block 4*a*.

In a final step shown in FIG. 12, bars 23 connected by a connection cross-piece 24 are positioned on the lateral surface of block 4*b*, from which the ends of contact shafts 1 project.

Figure 13:
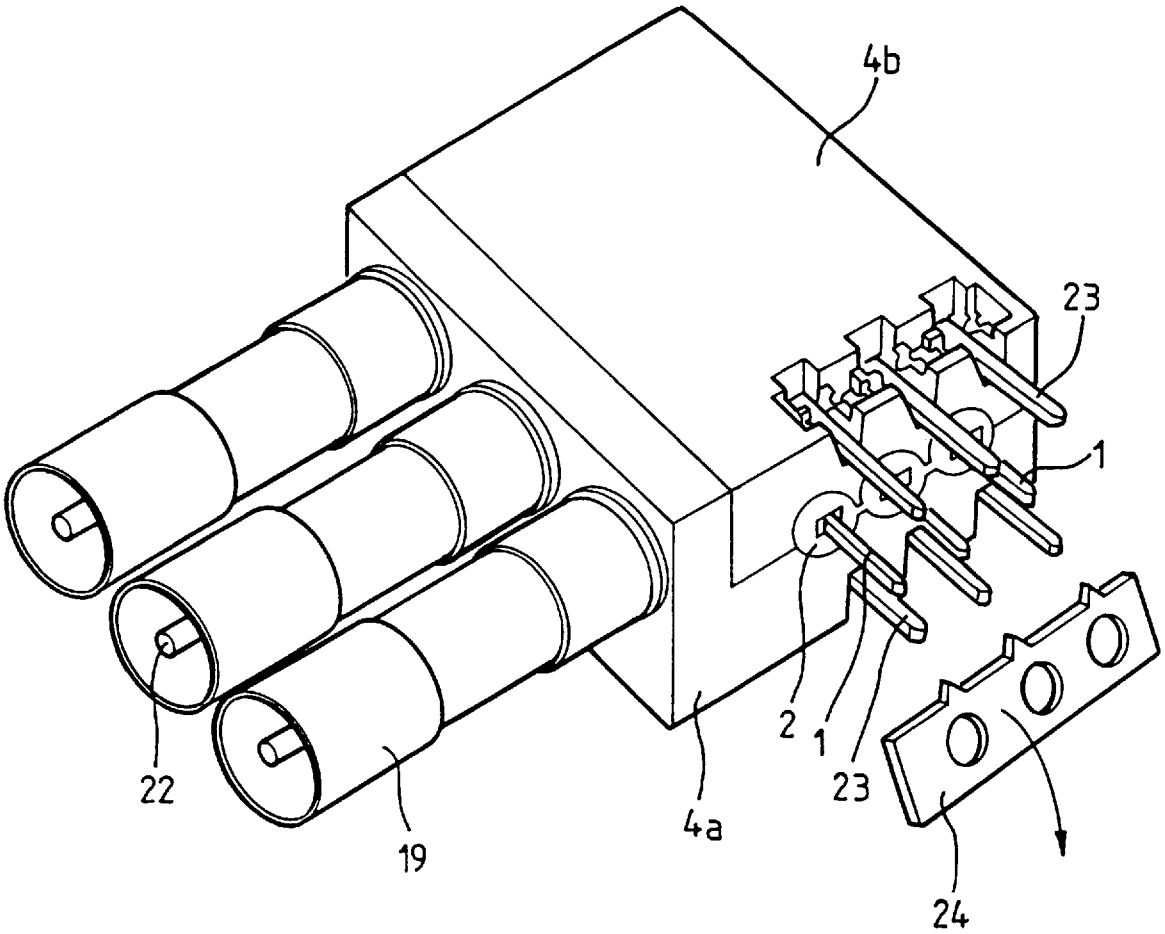
FIG. 13 illustrates the step of cutting the connection cross-pieces.

In the last step illustrated by FIG. 13, cross-pieces 21 and 24 are removed.

The principal advantages of the connector that has just been described are the following:

Due to the fact that shielding blocks 4*a*, 4*b* are obtained by molding, they can be manufactured in large runs at a reduced cost.

The interruption of shielding in zones 7*a*, 7*b* (see FIG. 1) permits reducing the size of the connector and placing contact shafts 1 very close to one another.

The cutting of the contact shafts in a sheet metal and the molding of the latter by the insulating material also permits facilitating the manufacture of the connectors and reducing their cost.

What is claimed is:

1. A connector having a series of metal contact shafts (1) spaced and bent into an elbow, embedded in an electrically insulating material (2), which is itself surrounded by a metal shielding (3), characterized in that the shielding (3) is made up of two superposed metal blocks (4*a*, 4*b*) having elbow channels (5*a*, 5*b*, 5*c*; 6*a*, 6*b*, 6*c*) on their contacting faces, these channels taking up the shafts (1) surrounded by the electrically insulating material (2), these channels being formed in such a way that the shielding (3) directly between the shafts (1) is interrupted in one rectilinear part of the elbow formed by the channels, this interrupting of shielding placing the insulating material (2) surrounding the contact shafts (1) in contact with the shielding (3) without creating any empty space in zones (7*a*, 7*b*) where the shielding is interrupted.

2. A connector according to claim 1, further characterized in that the two metal blocks (4*a*, 4*b*) of the shielding are molded.

3. A connector according to claim 1, further characterized in that the two shielding blocks (4*a*, 4*b*) have surfaces (8*a*, 8*b*) which are in contact with each other and which are planar.

4. A connector according to claim 1, further characterized in that each channel (5*a*, 5*b*, 5*c*; 6*a*, 6*b*, 6*c*) formed in one of blocks (4*a*, 4*b*) forms with the adjacent channel of the other block, a conduit of circular sections.

5. A connector according to claim 1, further characterized in that shielding (3) completely surrounds insulating material (2) in a part of the elbows formed by channels (5*a*, 5*b*, 5*c*; 6*a*, 6*b*, 6*c*), the channels comprising parts (9*a*, 9*b*; 10*a*, 10*b*) located between the contact shafts (1) surrounded by insulating material (2) and being separated by a recess (12*a*, 12*b*).

6. A connector according to claim 5, further characterized in that recesses (12*a*, 12*b*) each have a hole (13*a*, 13*b*) for the passage of an assembly screw for the two shielding blocks.

7. A connector according to claim 1, further characterized in that the two shielding blocks (4*a*, 4*b*) are roughly parallelepipedic, channels (5*a*, 5*b*, 5*c*; 6*a*, 6*b*, 6*c*) formed therein emerging from two adjacent lateral surfaces (14, 15) situated at right angles to one another, of said blocks (4*a*, 4*b*).

8. A connector according to claim 7, further characterized in that one (4*a*) of the blocks has, along one of its lateral surfaces, a protuberance (16) defining a bearing surface (17) perpendicular to an assembly plane (P) of the two blocks (4*a*, 4*b*), against which the other block (4*b*) rests, the channels formed in said blocks commencing outside protuberance (16) contiguous with circular conduits (18*a*, 18*b*, 18*c*) within the protuberance.

9. A connector according to claim 8, further characterized in that insulating material (2) around contact shafts (1) projects outside of circular conduits (18*a*, 18*b*, 18*c*) and is surrounded by a shielding socket (19) for each contact shaft (1) and this socket is pressed into a circular conduit (18*a*, 18*b*, 18*c*), so as to be in contact with shielding (3) of said blocks.

10. An electrical connector comprising:

electrical contacts spaced relative to each other and having a bent elbow shape;

electrical insulation on the contacts and forming connecting sections between the contacts to connect the contacts to each other; and electrical shielding comprising two blocks forming elbow shaped channels with the contacts and electrical insulation being located in the channels, wherein the blocks form recesses between adjacent ones of the channels that receive the connecting sections of the electrical insulation and wherein shielding is not provided by the electrical shielding directly between the electrical contacts at the recesses.

* * * * *